US007943872B2

(12) United States Patent
Scherl

(10) Patent No.: US 7,943,872 B2
(45) Date of Patent: May 17, 2011

(54) COMMAND DEVICE WITH SWITCHING ELEMENT MONITORING

(75) Inventor: Josef Scherl, Neunburg (DE)

(73) Assignee: Siemens Aktiengesellschaft, Munich (DE)

( * ) Notice: Subject to any disclaimer, the term of this patent is extended or adjusted under 35 U.S.C. 154(b) by 327 days.

(21) Appl. No.: 12/086,588

(22) PCT Filed: Nov. 8, 2006

(86) PCT No.: PCT/EP2006/068209
§ 371 (c)(1),
(2), (4) Date: Jun. 16, 2008

(87) PCT Pub. No.: WO2007/071495
PCT Pub. Date: Jun. 28, 2007

(65) Prior Publication Data

US 2009/0084663 A1 Apr. 2, 2009

(30) Foreign Application Priority Data

Dec. 20, 2005 (EP) ..... 05027927

(51) Int. Cl.
*H01H 27/00* (2006.01)

(52) U.S. Cl. ..... 200/43.04

(58) Field of Classification Search ..... 200/1 R, 200/1 B, 16 R–16 C, 17 R, 43.01, 43.04, 200/43.07, 50.01, 50.02, 520, 329, 307, 341, 200/50.06
See application file for complete search history.

(56) References Cited

U.S. PATENT DOCUMENTS

| | | | | |
|---|---|---|---|---|
| 3,436,497 | A * | 4/1969 | Mading | 200/16 A |
| 4,306,123 | A * | 12/1981 | Taylor | 200/16 A |
| 6,198,058 | B1 | 3/2001 | Graninger | |
| 6,987,235 | B2 * | 1/2006 | Sambar et al. | 200/520 |

FOREIGN PATENT DOCUMENTS

| | | |
|---|---|---|
| DE | 41 01 493 | 7/1992 |
| DE | 4111150 A1 | 10/1992 |
| EP | 0382345 A2 | 8/1990 |
| EP | 0660450 A2 | 6/1995 |
| EP | 1553609 A1 | 7/2005 |
| JP | 2003272468 | 3/2002 |
| JP | 2003303527 | 4/2002 |

* cited by examiner

*Primary Examiner* — Edwin A. Leon
(74) *Attorney, Agent, or Firm* — Harness, Dickey & Pierce, P.L.C.

(57) ABSTRACT

An embodiment of the invention relates to an electrical installation unit for making contact with electrical loads, wherein the installation unit has at least two contact elements. In at least one embodiment, an installation unit is disclosed in which an electrical connection provided between the two contact elements is necessarily interrupted when the installation unit is dismantled. In at least one embodiment, the installation unit includes at least one device for interrupting the conductive connection leading to the contact elements when the installation unit is dismantled. This at least one device, in at least one embodiment, includes two connecting elements in a switching element of the installation unit and, for example, a contact pin consisting of a conductive material, which produces a conductive connection between the connecting elements in a properly installed state of the installation unit. Alternatively, for example, the electrical connection between the connecting elements can be produced by a wire or a braided wire, by which the electrical connection is interrupted, for example by the wire or braided wire being ripped, when the installation unit is dismantled. A particularly advantageous application for the installation unit according to at least one embodiment is, for example, the use as an EMERGENCY STOP command device.

31 Claims, 5 Drawing Sheets

COMMAND DEVICE WITH SWITCHING ELEMENT MONITORING

PRIORITY STATEMENT

This application is the national phase under 35 U.S.C. §371 of PCT International Application No. PCT/EP2006/068209 which has an International filing date of Nov. 8, 2006, which designated the United States of America and which claims priority on European patent application number 05027927.2 filed Dec. 20, 2005, the entire contents of which are hereby incorporated herein by reference.

FIELD

At least one embodiment of the invention generally relates to an electrical installation unit for making contact with electrical consumers, the installation unit having at least two contact elements.

BACKGROUND

An installation unit is used in machines or electrical systems, which are operated by way of command devices, such as pushbuttons, selector switches, etc., which act on the controller. These command devices are fitted in control panels, operator panels, switching cabinet doors or housing covers. Command devices are generally of modular structure; in other words they comprise an actuator, a securing element (for example a ring nut or assembly support) and one or more switching elements, which are in the form of opening or closing contacts. For assembly purposes the actuator is generally inserted from the front through a hole in the control panel and assembled from the rear using a securing element. The switching elements are connected mechanically to the actuator or securing element by means of screws, snap-fit hooks or locks. The electrical connections of the switching elements are connected electrically to the controller by way of the terminals.

In the case of safety applications, such as EMERGENCY STOP command devices, it is a requirement that the signal is generated by the opening of necessarily opening contacts. In other words in the case of a non-actuated EMERGENCY STOP command device the contacts and therefore the associated electric circuit are closed. In the event of a breakdown or emergency, hitting the EMERGENCY STOP actuator, which is located in front of the control panel, causes the opening contact to be broken and the system or machine to switch to a safe state. However this only functions, if the spatial assignment between the actuator and the switching element is ensured. As a result of incorrect assembly or the action of a force it can happen that the switching elements are separated mechanically from the actuator. The EMERGENCY STOP command device can then no longer function; in other words when actuated in an emergency the contacts are not opened and the danger state is therefore not eliminated. This can result in fatal damage to man and machine.

Since, when the switching element is spatially separated from the actuator, the opening contacts remain, closed, this error cannot be detected by the controller. The operator cannot detect this error either, since it is normally not possible to see the switching elements, which are located behind the control panel or a housing. In specific applications the switching elements are not connected in a mechanically secure manner to the actuator. This is the case, when the switching elements including wiring are assembled in the base (for example on a DIN rail) in a housing and the actuator is secured in the cover. In this instance the required spatial assignment between the actuator and the switching elements depends on the cover being properly closed. If in the case of an actuated EMERGENCY STOP device the cover of a housing or the switching cabinet door is opened, the contacts, which are opened on actuation, close and the EMERGENCY STOP command is canceled, which can have dire consequences.

DE 41 01 493 and U.S. Pat. No. 6,198,058 disclose switching elements, which try to prevent or at least to detect the errors described above. These switching elements contain an opening and closing contact. In the non-actuated state the opening contact is closed and the closing contact is open. The switching element slider is hereby configured in such a manner that when the switching elements are correctly secured at the actuator the slider is actuated to the extent that the closing contact is closed but not to the extent that the opening contact is opened. If the opening and closing contacts are connected in series and there is correct spatial assignment of the switching element and the non-actuated actuator, the electric circuit is thus closed. On actuation of the EMERGENCY STOP device the opening contact is opened and the electric circuit is broken despite the closing contact still being closed. If the switching element becomes detached as a result of incorrect assembly or the action of a force, the partially pretensioned switching element slider moves due to spring force into its initial position and the electric circuit is broken by the opening of the closing contact. Since the closing contact is opened by a spring, there is no necessary opening within the meaning of the requirement (see EN 60947-5-1).

One solution patented in JP 2003 272468 is based on a special securing mechanism. The securing elements, which are secured on a support, are secured to the actuator by means of a twist lock. This twist lock is designed so that it opens the opening contact in any position other than the locking position. If the twist lock is moved into the locking position, without the switching elements being present at the actuator, or if there is an action of a force, the opening contact remains closed, even though the spatial assignment of the switching element and the actuator is not present. It is therefore not ensured that the relevant switching element is actually ready to operate at the actuator when the EMERGENCY STOP circuit is closed. One advantage compared with the two first-mentioned solutions is that the opening contacts are necessarily opened on actuation of the twist lock from the locked to the unlocked position.

In one solution patented in JP 2003 303527 the switching element slider, which supports the movable contact piece, is connected positively to the plunger of the actuator. If this connection is not present, the opening contact is opened by a spring, which acts on the switching element slider in the actuation direction. There is no necessary opening due to the opening of the contacts by spring force. The same mode of operation is used for a solution patented in WO 2004/023501. The particular feature here is the connection of the switching element slider and the actuator plunger by means of a bayonet lock.

SUMMARY

At least one embodiment of the invention is directed to a command device, which necessarily breaks the electric circuit when there is an incorrect spatial assignment between the actuator and the switching element.

This object is achieved with an electrical installation unit of the type mentioned in the introduction in that the installation unit has means, which are provided to break a conducting connection to the contact elements when the installation unit is dismantled.

If the correct spatial assignment is not or is no longer present (for example due to incorrect assembly, the action of a force or a device cover that is not properly closed), the electrical connection likewise is not or is no longer present and the electric circuit is thus broken. In contrast to the solution with the closing contact connected in series (see DE 41 01 493 and U.S. Pat. No. 6,198,058), with the inventive solution of at least one embodiment the electric circuit is necessarily broken when the switching element is removed from the actuator, in other words the breaking of the electric circuit is not dependent on a spring force, which may fail due to a fractured spring, welded contacts or increased friction. Also the necessary closing contact is not required with the present solutions. As a result the inventive solution can be produced more easily, takes up less space and is also more economical.

In one advantageous embodiment the installation unit has a contact facility to break the conducting connection. This contact facility is present in addition to the breaking means when the installation unit is dismantled. This contact facility allows the installation unit to be used for example as an on-off switch or pushbutton.

The contact facility advantageously has a relaxed and a tensioned position subject to the action of the spring mechanism. This allows a switching mechanism configured as an on-off switch or pushbutton to be realized in a simple manner.

A return spring is advantageously provided here as the spring mechanism to tension the contact facility. Thus, the spring mechanism can be realized using simple standard components.

The contact facility is advantageously provided in the relaxed position to close and in the tensioned position to break the conducting connection. Thus, when the contact facility is not actuated, the electric circuit is closed, with the result that the installation unit is particularly suitable as a command device for breaking an electric circuit.

A plunger—having a rest position and an actuation position—is advantageously provided to act-on the contact facility, it being possible to move the contact facility into the relaxed position by moving the plunger into its rest position and into the tensioned position by moving the plunger into its actuation position. Transmission of the force required for actuation by way of the plunger means that it is possible to attach an actuation element in a simple manner using standard components.

Therefore to act on the plunger the installation unit advantageously has an actuator with a region provided to guide the plunger and a switching element that can be assigned in a spatially fixed manner to the actuator and is provided to receive the contact facility. The breaking devices hereby ensure that in the event of an incorrect spatial assignment between the actuator and the contact facility the electric circuit is broken. This separate embodiment of the actuator facility and the contact facility for example facilitates the assembly of the command device on a control panel.

To assemble the installation unit a securing element is advantageously provided on one surface. This can be used to fix the actuator, which can be inserted through a recess in the surface from the side opposite the securing element. This ensures that the command device is held securely.

The switching element can advantageously be connected indirectly by way of the securing element or directly to the actuator by screwing or snap-fitting. This allows the installation unit to be assembled in a reliable and simple manner.

In one particularly advantageous embodiment the at least one device for breaking the conducting connection includes a contacting element, which is assigned to a detachable part of the installation unit, and two connecting elements for making contact with the contacting element. By assigning the contacting element to the detachable part of the installation unit it is ensured in a simple manner that the conducting connection is broken when the installation unit is dismantled.

A conductive contact pin is hereby advantageously provided as the contacting element, being arranged between the two connecting elements when the installation unit is correctly assembled.

The contact pin and/or the two connecting elements advantageously have a spring characteristic and the gap between the connecting elements is smaller than the diameter or width of the contact pin. Utilizing the spring characteristic of the two connecting elements or the contact pin, which establishes the connection between the two parts during uninterrupted operation, ensures a reliable and continuous electrical connection. The spring characteristic in the contact pin can hereby be realized by way of a longitudinal slot.

An insulating material is advantageously provided to embed the contact manner in such a manner that when the contact pin makes contact with the connecting elements, no further conductive part can be touched. Restrictions relating to permissible operating voltage or operating current are therefore not necessary.

In one particularly advantageous embodiment of the installation unit, which is executed with a separate actuator and contact facility, two connecting elements in the switching element and a conductive contact pin secured to the actuator are provided as the means for breaking the conducting connection, it being possible to establish a conducting connection between the connecting elements by way of the contact pin, which can be inserted through a recess in a housing of the switching element, by means of these when there is a correct spatial assignment between the actuator and the switching element. The presence of the contact pin, which is connected in an inseparable manner to the actuator, automatically ensures that standard switching elements without absence protection cannot be fitted in the case of actuators for which provision is made for the use of switching elements with absence protection.

The contact pin and/or the two connecting elements advantageously also have a spring characteristic, with the gap between the connecting elements being smaller than the diameter or width of the contact pin.

An insulating material is likewise advantageously provided here to embed the contact pin in such a manner that when the contact pin makes contact with the connecting elements, no further conductive part can be touched.

The length of the contact pin is also advantageously dimensioned so that when the switching element is detached from the actuator, the conducting connection between the connecting elements can be broken, before it is no longer possible to exert an action on the plunger by way of the actuator. This ensures that the conducting connecting is already broken before the actuator can no longer carry out its function.

The recess in the housing of the switching element, through which the contact pin can be inserted, is advantageously funnel-shaped. This facilitates the joining of the switching element and the actuator.

In a further advantageous embodiment an electrical conductor is provided as the contacting element instead of the contact pin. This conductor can be a wire or braided wire for example.

The electrical conductor hereby advantageously has electrical insulation. As a result there are again no restrictions relating to operating current and operating voltage in contrast to standard switching elements.

One end of the electrical conductor is advantageously connected securely to one connecting element and the other end can be connected to the other connecting element by way of a plug-in connection. This makes it possible to break the electric circuit in a non-destructive manner by canceling the connection between the electrical conductor and the connecting element.

In one particularly advantageous embodiment of the installation unit, which is executed with a separate actuator and switching element, two connecting elements in the switching element and an electrical conductor that can be guided through two recesses in a housing of the switching element are provided as the means for breaking the conducting connection, with the electrical conductor being connected securely at one end to a connecting element and further to a correct spatial assignment between the switching element and the actuator being able to be guided through a recess provided for this purpose on a housing of the actuator and being able to be connected at its second end to the second connecting element.

The electrical conductor here also advantageously has electrical insulation.

The length of the electrical conductor is advantageously dimensioned so that when the switching element is detached from the actuator, the conducting connection between the two connecting elements can be broken, before no further action can be exerted on the plunger by way of the actuator. This ensures that spatial separation of the actuator and the switching element also means electrical breaking of the conducting connection.

A plug-in connection can again advantageously be provided to connect the second end of the electrical conductor to the second connecting element.

In one particularly advantageous embodiment of the installation unit the securing mechanism is provided between the switching element and the actuator to separate the switching element from the actuator when the plunger is locked and a certain actuation force is exceeded. Contacts can become welded further to a short circuit. If the welding is so extensive that the contacts are not separated for example when an EMERGENCY STOP command device is actuated, the safety-related function of the device, in other words the opening of the contacts, is no longer present. With the inventive switching element the securing mechanism (for example snap-fit hooks) between the switching element and the actuator can be configured so that if a certain welding force is exceeded, the switching element becomes detached from the actuator by transmission of the actuation force by way of the locked slider (for example by means of a weak point) and as a result the electric circuit is necessarily broken by separation of the contact pin from the switching element despite the welded contacts.

In a further advantageous embodiment a controller is provided to measure the potential difference between the contact pins and at least one of the two contact elements of the installation unit. With a correctly assembled switching element and an electric circuit closed by the contact facility, the contact pins and both contact elements of the installation unit have the same voltage potential. When the contact facility is open, the contact element on the same side as the contact pin and the contact pin have the same potential but a different potential from the contact element on the opposite side of the contact facility. It is thus possible, in the case of an EMERGENCY STOP chain (a series circuit comprising a number of EMERGENCY STOP command devices in a system) for the controller to determine and evaluate which of a number of EMERGENCY STOP devices has been actuated. If the potential of the contact pin differs from the potential of the contact element on the same side of the contact facility as the contact pin, it can be concluded that the correct spatial assignment of the switching element and the actuator is not or is no longer present. The voltage potential of the contact pin to the contact elements of the switching element, which is a function of the operating state, can thus also be utilized for display and alarm purposes.

In one advantageous embodiment of the installation unit a controller is provided to measure the potential difference between the two sides of the contact facility. It can thus be determined in a simple manner whether the contact facility is open or closed.

In a further advantageous embodiment of the installation unit a controller is provided to measure the potential difference between the two sides of the means for breaking the conducting connection. It can thus be determined in a simple manner whether a correct spatial assignment of actuator to switching element is present.

The installation is advantageously provided for use as an EMERGENCY STOP command device. If the switching element is detached from the actuated EMERGENCY STOP actuator, for example by the opening of a housing, in which the switching elements are arranged in the base and the actuator in the cover, with the known solutions the EMERGENCY STOP circuit is temporarily closed by the closing of the opening contact, before the electric circuit is again broken by the opening of the closing contact. This temporary closing of the EMERGENCY STOP circuit can result in dangerous operating states in some instances. This is not the case with the inventive solution.

BRIEF DESCRIPTION OF THE DRAWINGS

The invention is described and explained in more detail below with reference to the example embodiments illustrated in the figures, in which.

DETAILED DESCRIPTION OF THE EXAMPLE EMBODIMENTS

Figure 1:
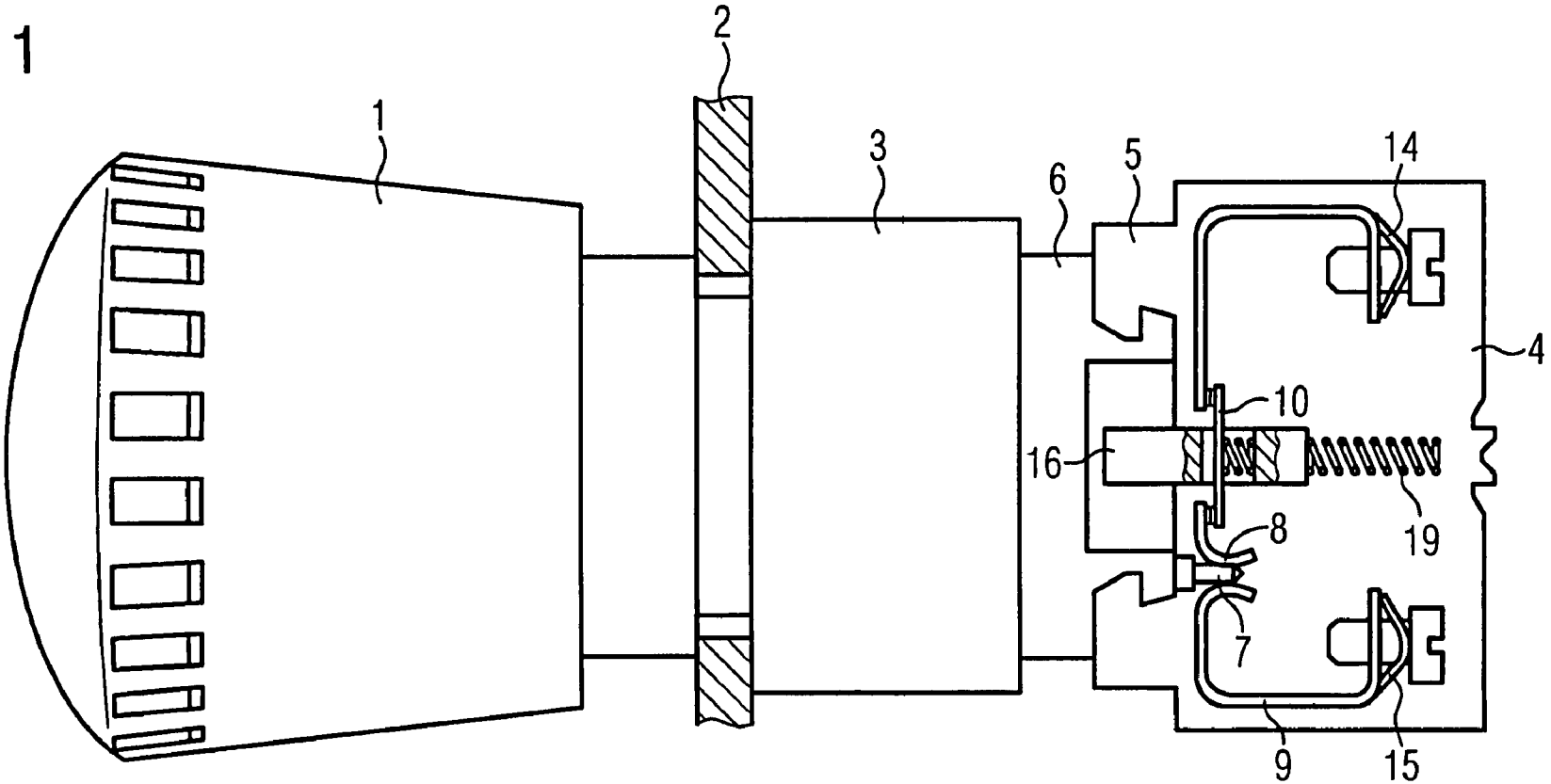
FIG. 1 shows an embodiment of an inventive installation unit embodied as an EMERGENCY STOP actuator in the non-actuated state, with a contact pin being provided as the means for breaking the conducting connection.

FIG. 1 shows an inventive electrical installation unit in the form of an EMERGENCY STOP command device. The command devices is modular in structure and includes a switching element 4 and an actuator 6, with the actual operating element 1, by which a user operates the EMERGENCY STOP command device, being associated with the actuator 6. The EMERGENCY STOP command device is fitted on a control panel 2. To this end the actuator 6 has been guided through a hole in the control panel 2 and secured by way of a securing element 3. The switching element 4 has then been assembled by way of the switching element securing system 5 by snap-fitting on the actuator 6. The contact elements of the installation unit are embodied as terminals 14, 15.

A contact pin 7 serves as the at least one device for breaking the conducting connection between the terminals 14 and 15 and a fixed contact piece 8 and a terminal piece 9 serve as the connecting elements. The curved form of the fixed contact piece 8 and the terminal piece 9 gives both connecting elements an elastic characteristic, which can be established by a reliable electrical connection to the contact pin 7.

The contact pin 7, which is connected in an inseparable manner to the actuator 6, is guided through a recess provided for the purpose on the switching element 4, the recess being advantageously funnel-shaped, when the switching element 4 is assembled on the actuator 6. The presence of the contact pin 7 connected inseparably to the actuator 6 automatically ensures that standard switching elements without absence protection cannot be fitted to actuators 6, for which provision is made for the use of switching elements 4 with absence protection. When the actuator 6 is detached from the switching element 4, the contact pin 7 loses electrical contact with the connecting elements 8, 9 and is therefore de-energized as soon as it is separated from the switching element 4. This means there are also no problems with shock protection.

The switching element 4 also has a contact facility 10, which is operated by a switching element slider 16. During actuation of the switching element slider 16 a return spring 19 is switched to a tensioned state, from which, when the actuation force on the switching element slider 16 ceases, it moves said switching element slider 16 back to its initial position. This structure is not only suitable for EMERGENCY STOP command devices but quite generally for pushbuttons of any type.

Figure 2:
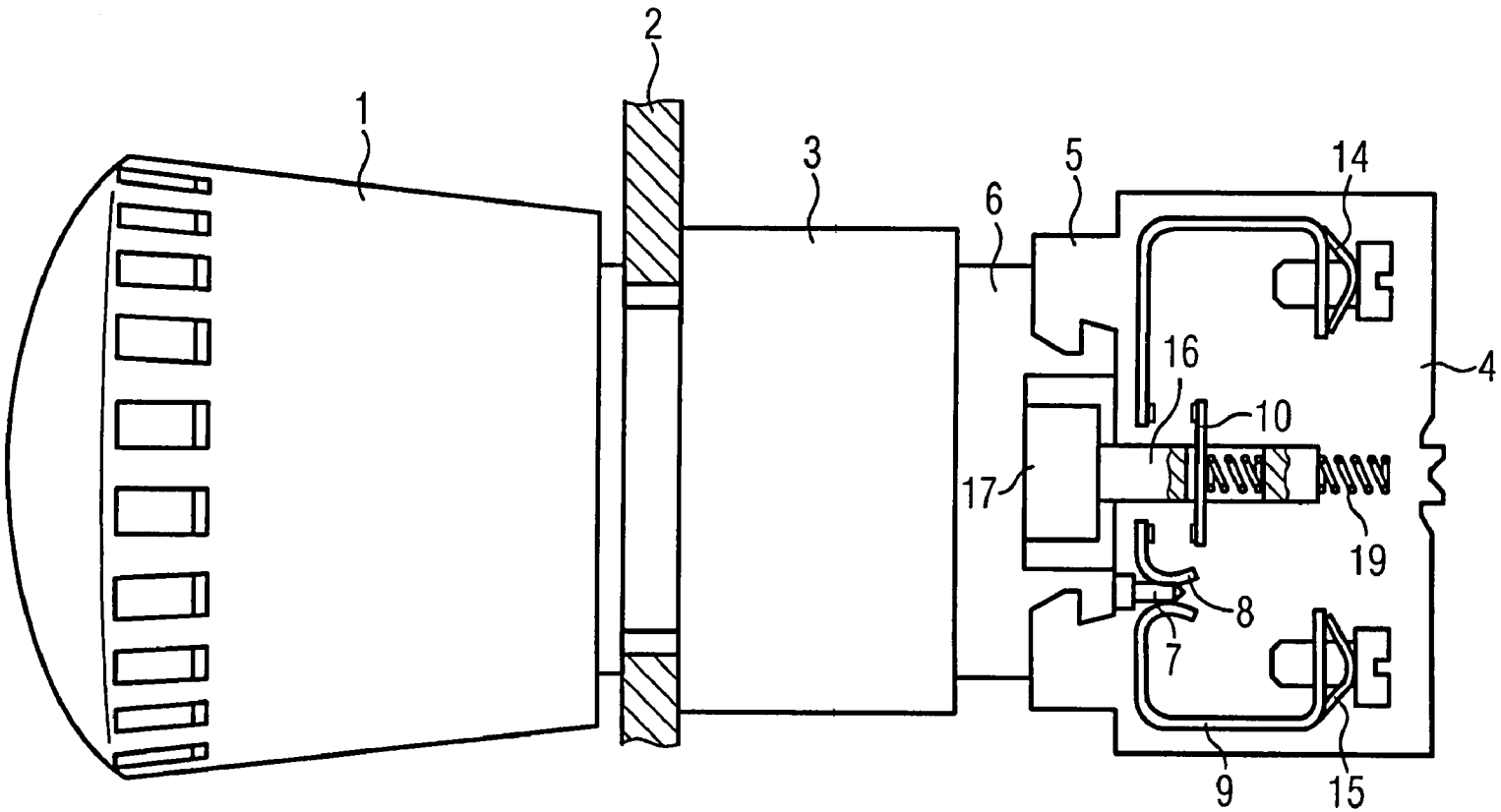
FIG. 2 shows the EMERGENCY STOP actuator from FIG. 1 in the actuated state.

FIG. 2 shows the EMERGENCY STOP command device from FIG. 1 in the actuated state. It can be seen how actuation of the operating element 1 causes the actuation force to act on the switching element slider 16 by way of a plunger 17, to open the contact facility 10. As stated above, this causes the return spring 19 to switch to its tensioned state. See under FIG. 1 for an explanation of the further reference characters.

Figure 3:
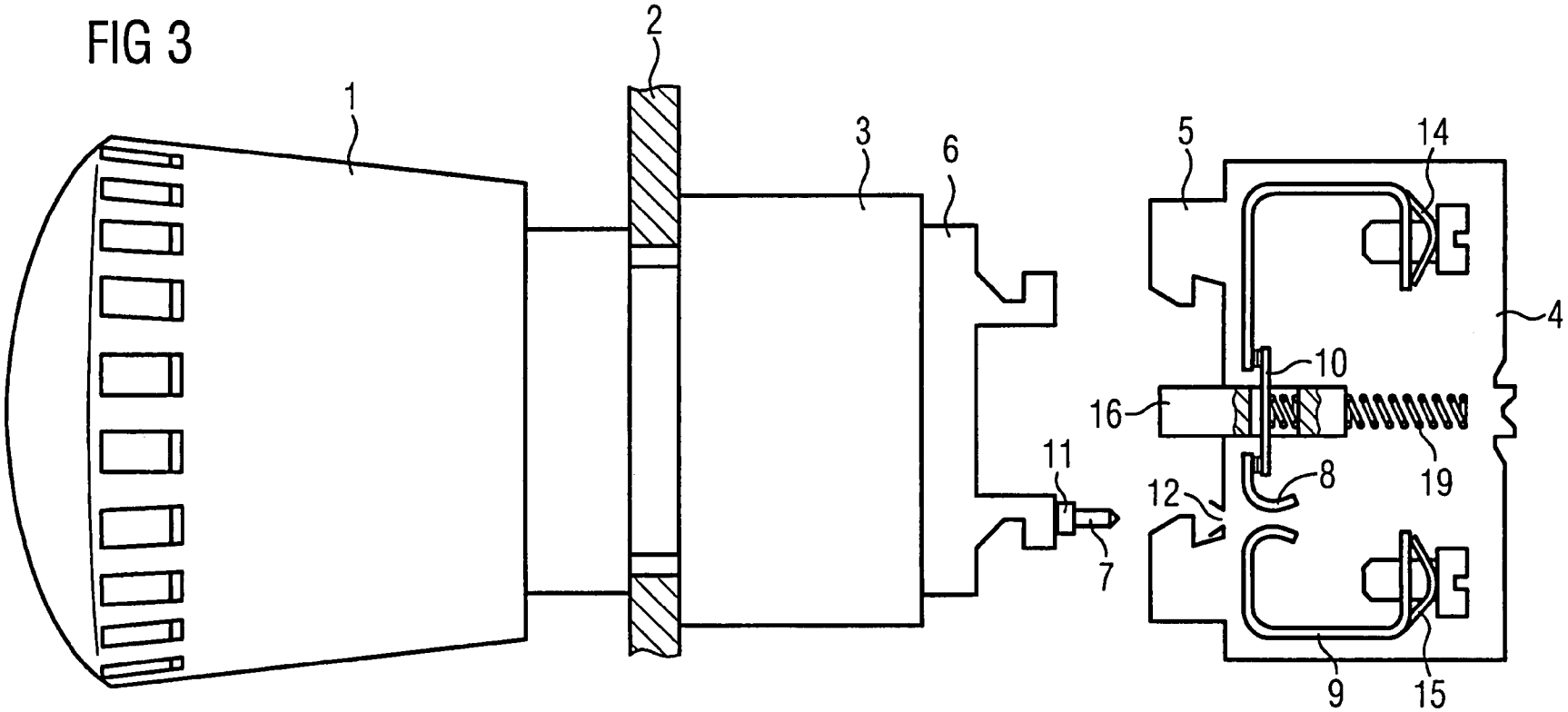
FIG. 3 shows the EMERGENCY STOP actuator from FIG. 1 with the actuator separated from the switching element.

FIG. 3 again shows the EMERGENCY STOP command device from FIG. 1, with the switching element 4 detached from the actuator 6. In this dismantled state the contact facility 10 is closed by the restoring force of the return spring 19. It clearly shows the funnel-shaped recess in the switching element housing 12, through which the switching pin 7 is guided during assembly of the switching element 4 with the actuator 6. An insulating material 11 is applied to the contact pin 7, to ensure that it is no longer possible to touch any conductive part, once the contact pin 7 has established a conducting connection to the connecting elements 8, 9. See under FIG. 1 for an explanation of the further reference characters.

Figure 4:
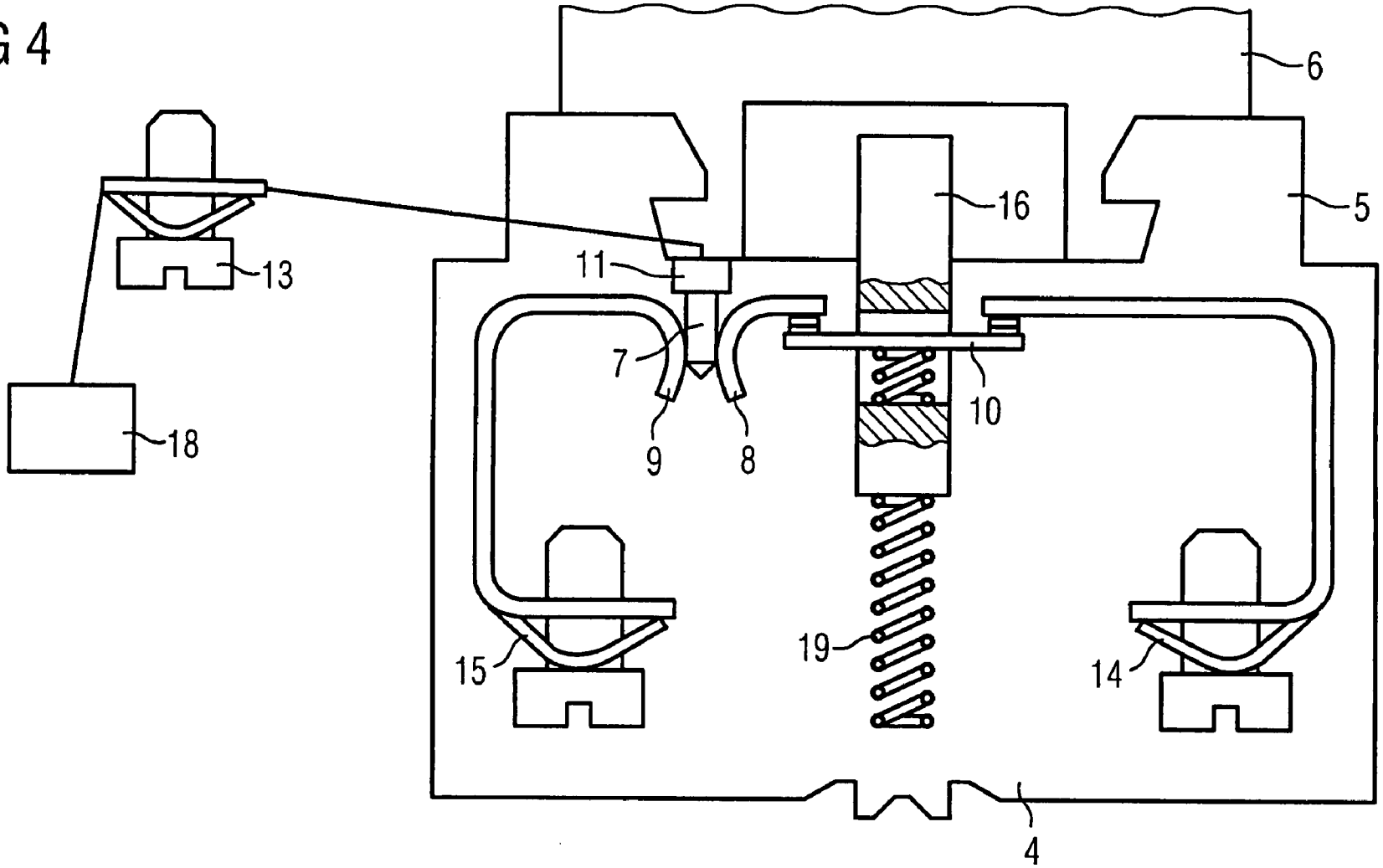
FIG. 4 shows the switching element of the EMERGENCY STOP actuator from FIG. 1 with a controller for measuring the potential difference between the contact pin and contact elements of the installation unit.

FIG. 4 shows only the switching element 4, which is secured to the actuator 6 by way of the switching element securing system 5. It shows a schematic diagram of a further terminal for the contact pin 13, by way of which the potential of the contact pin 7 is measured by way of a controller 18. With a correctly assembled switching element 4 and an electric circuit closed by the contact facility 10 the two terminals 14, 15 and the contact pin 7 or the terminal for the contact pin 13 have the same voltage potential. When the EMERGENCY STOP is actuated, the terminal 15 and contact pin 7 have the same potential but a different potential from the terminal 14.

It is thus possible for example, in the case of an EMERGENCY STOP chain, in other words a series circuit comprising a number of EMERGENCY STOP command devices in a system, for the controller to determine and evaluate which of a number of EMERGENCY STOP devices has been actuated. If the potential of the contact pin 7 differs from the potential of the terminal 15, it can be concluded that the correct spatial assignment of the switching element 4 and the actuator 6 is not or is no longer present. The voltage potential of the contact pin 7 to the terminals of the installation unit 14, 15, which is a function of the operating state, can thus also be utilized for display and alarm purposes. See under FIG. 1 for an explanation of the further reference characters.

Figure 5:
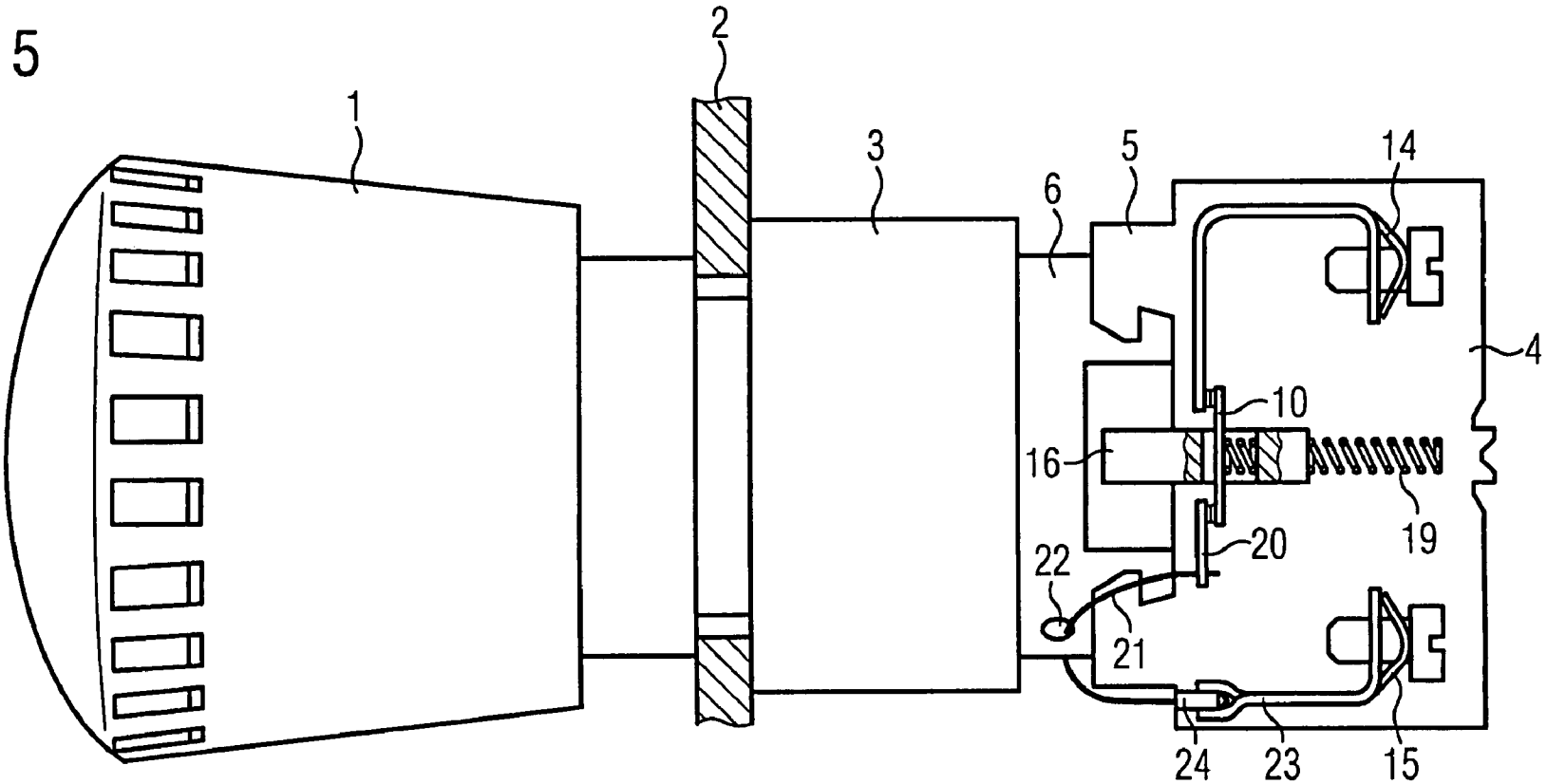
FIG. 5 shows the EMERGENCY STOP actuator from FIG. 1, with a wire or braided wire being provided as the at least one device for breaking the conducting connection instead of the contact pin as shown in FIGS. 1 to 4.

FIG. 5 shows an embodiment of the inventive electrical installation unit, with a wire or braided wire 21 being used as the means for breaking the conducting connection instead of the contact pin 7 as shown in FIGS. 1 to 4. Here one end of the wire or braided wire 21 is secured in a fixed manner to a fixed contact piece 20, which represents one of the two connecting elements, with a plug-in connection 24 being fitted to the other end of the wire or braided wire 21, said plug-in connection 24 being connected to the second connecting element, the terminal piece 23. The wire or braided wire 21 is guided through a recess on the actuator 22, thereby ensuring that when the switching element 4 is detached from the actuator 6, the conducting connection between the terminals of the installation unit 14 and 15 is necessarily broken by removing the plug-in connection 24 from the terminal piece 23. The length of the wire 21, which is preferably electrically insulated, is dimensioned so that when the EMERGENCY STOP command device is dismantled, the electrical connection is broken by removing the plug-in connection 24 from the terminal piece 23, before the contact facility 10 can no longer be opened by operating the operating element 1. Alternatively the second end of the wire 21 can also be connected in a fixed manner to the terminal piece 23 instead of by way of the plug-in connection 24. In this case the conducting connection is necessarily opened when the EMERGENCY STOP command device is dismantled by tearing the wire 21. See under FIG. 1 for an explanation of the further reference characters.

To summarize, an embodiment of the invention relates to an electrical installation unit for making contact with electrical consumers, the installation unit having at least two contact elements. An embodiment of the invention specifies an installation unit, wherein an electrical connection between the two contact elements is necessarily broken when the installation unit is dismantled. The installation unit has at least one device, provided to break a conducting connection to the contact elements when the installation unit is dismantled. This at least one device can include two connecting elements in a switching element of the installation unit and for example a contact pin made of a conducting material, which establishes a conducting connection between the connecting elements when the installation unit is correctly assembled. Alternatively the electrical connection between the connecting elements can be established for example by a wire or braided wire, by which the electrical connection is broken, for example by tearing the wire or braided wire, when the installation unit is dismantled. One particularly advantageous application of the inventive installation unit is for example as an EMERGENCY STOP command device.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electrical installation unit for making contact with electrical consumers, comprising:

a switching element having a housing and at least two contact elements in the housing;

a contact facility in the housing to break a conducting connection to the contact elements; and an actuator attached to an outside surface of the housing and detachably engaged with a securing element outside of the housing, the actuator being configured to break the conducting connection and including a contacting element connected to the actuator and in electrical communication with at least one contact element when the contact facility is in an open position and when the contact facility is in a closed position.

2. The installation unit as claimed in claim 1, wherein the contact facility includes a relaxed and a tensioned position subject to the action of a spring mechanism.

3. The installation unit as claimed in claim 2, wherein a return spring is provided as the spring mechanism to tension the contact facility.

4. The installation unit as claimed in claim 2, wherein the contact facility is provided in the relaxed position to close and in the tensioned position to break the conducting connection.

5. The installation unit as claimed in claim 2, further comprising:

a plunger, having a rest position within the actuator and an actuation position outside of the actuator, provided to act on the contact facility, the contact facility being movable to the relaxed position by moving the plunger to its rest position and movable to the tensioned position by moving the plunger to its actuation position.

6. The installation unit as claimed in claim 5, wherein the actuator is engagable with the plunger to guide the plunger.

7. The installation unit as claimed in claim 6, further comprising:

a securing element, provided on one surface to assemble the installation unit, to fix the actuator, which is insertable through a recess in the surface from the side opposite the securing element.

8. The installation unit as claimed in claim 7, wherein the switching element is connectable at least one of indirectly by way of the securing element and directly to the actuator by at least one of screwing and snap-fitting.

9. The installation unit as claimed in claim 1, further including two connecting elements in the housing for making contact with the contacting element, wherein at least one of the connecting elements includes a funnel shaped portion configured to receive the contacting element.

10. The installation unit as claimed in claim 9, wherein a conductive contact pin is provided as the contacting element and the conductive pin is immovably affixed to the actuator.

11. The installation unit as claimed in claim 10, wherein at least one of the contact pin and the two connecting elements have a spring characteristic and wherein a gap between the connecting elements is smaller than at least one of the diameter and the width of the contact pin.

12. The installation unit as claimed in claim 10, wherein an insulating material is provided to embed the contact pin in such a manner that when the contact pin makes contact with the connecting elements, no further conductive part is touchable.

13. The installation unit as claimed in claim 6, wherein two connecting elements in the switching element and a conductive contact pin secured to the actuator are provided for breaking the conducting connection, a conducting connection between the connecting elements being establishable by way of the contact pin, the contact pin being insertable through a recess in the housing of the switching element, by way of these when there is a correct spatial assignment between the actuator and the switching element.

14. The installation unit as claimed in claim 13, wherein at least one of the contact pin and the two connecting elements include a spring characteristic and wherein the gap between the connecting elements is smaller than at least one of the diameter and the width of the contact pin.

15. The installation unit as claimed in claim 13, wherein an insulating material is provided to embed the contact pin in such a manner that when the contact pin makes contact with the connecting elements, no further conductive part is touchable.

16. The installation unit as claimed in claim 13, wherein the length of the contact pin is dimensioned so that when the switching element is detached from the actuator, the conducting connection between the connecting elements is breakable, before it is no longer possible to exert an action on the plunger by way of the actuator.

17. The installation unit as claimed in claim 13, wherein the recess in the housing of the switching element, through which the contact pin is insertable, is funnel-shaped.

18. The installation unit as claimed in claim 9, wherein an electrical conductor is provided as the contacting element.

19. The installation unit as claimed in claim 18, wherein the electrical conductor includes electrical insulation.

20. The installation unit as claimed in claim 18, wherein one end of the electrical conductor is connected securely to a one connecting element and wherein the other end is connectable to the other connecting element by way of a plug-in connection.

21. The installation unit as claimed in claim 6, wherein two connecting elements in the switching element and an electrical conductor that is guidable through two recesses in a housing of the switching element are provided as the at least one device for breaking the conducting connection, the electrical conductor being connected securely at one end to a connecting element and further to a correct spatial assignment between the switching element and actuator being able to be guided through a recess provided for this purpose on a housing of the actuator and being able to be connected at its second end to the second connecting element.

22. The installation unit as claimed in claim 21, wherein the electrical conductor includes electrical insulation.

23. The installation unit as claimed in claim 21, wherein the length of the electrical conductor is dimensioned so that when the switching element is detached from the actuator, the conducting connection between the two connecting elements is breakable, before it is no longer possible to exert an action on the plunger by way of the actuator.

24. The installation unit as claimed in claim 21, wherein a plug-in connection is provided to connect the second end of the electrical conductor to the second connecting element.

25. The installation unit as claimed in claim 6, wherein the securing mechanism between the switching element and the actuator are provided to separate the switching element from the actuator when the plunger is locked and a certain actuation force is exceeded.

26. The installation unit as claimed in claim 10, wherein a controller is configured to determine a spatial assignment of the switching element and the actuator by measuring the potential difference between the contact pin and at least one of the two contact elements of the installation unit.

27. The installation unit as claimed in claim 1, wherein a controller is configured to determine an operating state of the installation unit for at least one of a display purpose and an alarm purpose by measuring the potential difference between the two sides of the contact facility.

28. The installation unit as claimed in claim 1, wherein a controller is provided to measure the potential difference between the two sides of the at least one device for breaking the conducting connection.

29. The installation unit as claimed in claim 1, wherein the installation unit being provided for use as an EMERGENCY STOP command device.

30. The installation unit as claimed in claim 2, wherein the contact facility is provided in the relaxed position to close and in the tensioned position to break the conducting connection.

31. An electrical installation unit for making contact with electrical consumers, comprising:

a switching element having a housing and at least two contact elements in the housing;

a contact facility in the housing to break a conducting connection to the contact elements;

an actuator detachably engaged with a securing element of the housing for breaking the conducting connection and including a contacting element connected to the actuator and in electrical communication with at least one contact element when the contact facility is in an open position and when the contact facility is in a closed position, wherein the contact facility includes a relaxed and a tensioned position subject to the action of a spring mechanism; and a plunger, having a rest position within the actuator and an actuation position outside of the actuator, provided to act on the contact facility, the contact facility being movable to the relaxed position by moving the plunger to its rest position and movable to the tensioned position by moving the plunger to its actuation position.

* * * * *